US006691332B2

(12) United States Patent
Khoo

(10) Patent No.: US 6,691,332 B2
(45) Date of Patent: Feb. 17, 2004

(54) DUAL VOLUME DISCHARGE OUTLET VALVE APPARATUS

(75) Inventor: Kah Hin Khoo, Winthrop (AU)

(73) Assignee: VGM (Aust) PTY Ltd., West Perth (AU)

( * ) Notice: Subject to any disclaimer, the term of this patent is extended or adjusted under 35 U.S.C. 154(b) by 0 days.

(21) Appl. No.: 10/096,748

(22) Filed: Mar. 14, 2002

(65) Prior Publication Data

US 2003/0000007 A1 Jan. 2, 2003

Related U.S. Application Data

(63) Continuation of application No. PCT/AU00/01120, filed on Sep. 15, 2000.

(30) Foreign Application Priority Data

Sep. 16, 1999 (AU) ..... PQ2935

(51) Int. Cl.[7] ..... E03D 1/14
(52) U.S. Cl. ..... 4/325; 4/410
(58) Field of Search ..... 4/324–326

(56) References Cited

U.S. PATENT DOCUMENTS

| | | | | |
|---|---|---|---|---|
| 4,811,432 A | | 3/1989 | Harris | |
| 5,121,510 A | * | 6/1992 | Ricalde Medina | 4/326 |
| 5,465,432 A | | 11/1995 | Miller | |
| 5,685,025 A | * | 11/1997 | Chen | 4/325 |
| 5,699,563 A | * | 12/1997 | McClure | 4/325 |

FOREIGN PATENT DOCUMENTS

| | | | |
|---|---|---|---|
| AU | 32581/84 | A | 3/1985 |
| AU | 43177/85 | A | 12/1985 |
| AU | 10608/92 | A | 8/1992 |
| AU | 39166/95 | A | 6/1996 |
| AU | 40804/96 | A | 7/1996 |
| DE | 268 265 | A1 | 5/1989 |
| WO | 96/29481 | A1 | 9/1996 |
| WO | 97/17503 | A1 | 5/1997 |

* cited by examiner

*Primary Examiner*—Charles E. Phillips
(74) *Attorney, Agent, or Firm*—Birch, Stewart, Kolasch & Birch, LLP

(57) ABSTRACT

A dual volume discharge apparatus for selectively discharging a full flush or a half flush of liquid from a reservoir, said discharge apparatus including: actuator means (1) selectively moveable from a closed position to either a full flush position or a half flush position, sealing means (11) moveable by said actuator means (1) from a closed position to either a full flush position or a half flush position, said sealing means being biased toward said closed position when in said half flush position, liquid outlet (17) which is sealed by said sealing means (11) to prevent flow of liquid out of said reservoir when said sealing means (11) is in said closed position and which allows flow of liquid out of said reservoir when said sealing means (11) is in the full flush position or the half flush position, stop means (21) co-operable with said sealing means and being biased towards position capable of holding said sealing means in said half flush position when said actuator means in said half flush position until a predetermined volume of liquid has been discharged from said reservoir and then allowing said sealing means (11) to move to said closed position thereafter.

26 Claims, 4 Drawing Sheets

DUAL VOLUME DISCHARGE OUTLET VALVE APPARATUS

This is a continuation of PCT/AU00/01120 filed Sep. 15, 2000.

The present invention relates to valves, more particularly to outlet valves to control the flow of liquid. It will be convenient to describe the invention in relation to outlet valves for cisterns, especially water cisterns for use in toilets although it will be appreciated that the invention may have wider application.

Environmental concerns about the excessive use of water has lead to numerous domestic practices aimed at reducing water wastage. One such practice involves the use of more water-efficient toilet flushing systems, in particular cisterns which allow the user the option of flushing using a full volume of water or a reduced volume. Building regulations differ from country to country but generally such regulations specify the particular minimum and maximum volumes of water to be used, for example a full flush of 6 liters and a half flush of 3 liters. Although the terms "full flush" and "half flush" are used throughout the description and claims of this specification, it will be appreciated by the skilled addressee that "half flush" is not necessarily exactly half the volume of a "full flush" but, for example, a full flush may equate to 9 liters and a half flush to 6 liters. The term "half flush" should therefore be considered to refer to any desired reduced flushing volume.

A wide variety of dual-flush cistern outlet valves have been proposed and used. Many of these comprise apparatus for dividing the cistern into two separate reservoirs each having separate outlet valves: when a half flush is required, one of the outlet valves is opened so that one of the reservoirs empties. When a full flush is required, both valves are opened so that both reservoirs empty. These and many other dual-flush apparatus generally require two separate actuating systems to open the two valves. It is desirable to reduce the number of separately manufactured parts for a dual flush system.

SUMMARY AND OBJECTS OF THE INVENTION

It is an object of the present invention to provide a dual flush outlet valve which can be made using a minimum of separate moveable parts. It is a further object to provide a dual flush outlet valve which can be suitably adjusted to allow a variety of full and half flush volumes without the need for differently dimensioned components so that the one apparatus can be used throughout the world and adjusted easily to comply with differing regulatory requirements on flushing volumes. It is yet a further object of the present invention to provide a dual flush apparatus which utilises a pivoting or 'flapper" valve rather than a plunger valve.

Most known dual flush outlet valves also have limited scope to provide variable or extra capacity for overfilling relief from the reservoir, for example In the case of failure of the reservoir filling valve to shut-off when the reservoir has been filled to its desired level. It is an object of another aspect of the present invention to provide a dual flush outlet valve with added fixed or variable overflow protection.

In accordance with the present invention there is provided a dual volume discharge apparatus for selectively discharging a full flush or a half flush of liquid from a reservoir, said discharge apparatus including:

actuator means selectively moveable from a closed position to either a full flush position or a half flush position, sealing means moveable by said actuator means from a closed position to either a full flush position or a half flush position, said sealing means being biased toward said closed position when in said half flush position, liquid outlet which is sealed by said sealing means to prevent flow of liquid out of said reservoir when said sealing means is in said closed position and which allows flow of liquid out of said reservoir when said sealing means is in the full flush position or the half flush position, stop means co-operable with said sealing means and being biased towards position capable of holding said sealing means in said half flush position when said actuator means is moved to said half flush position until a predetermined volume of liquid has been discharged from said reservoir and then allowing aid sealing means to move to said closed position thereafter.

The actuator means is selectively moveable from a closed position to either a full flush position or to a half flush position. The actuator means preferably further includes means for selecting either the half flush or full flush functions. In a preferred embodiment the actuator means includes twin selection means, a first selection means being adapted to move said actuator means from the closed position to the half flush position, and a second selection means being adapted to move the actuator means from the closed position to the full flush position. Said means may be in the form of a dual press-button device where each button when depressed causes the actuator means to move a certain distance, the two buttons each moving the actuator means a different distance. Preferably the half flush position is intermediate the closed and full flush positions and the distance the first selection means moves the actuator means when depressed by the user is less than the distance the second selection means moves the actuator means when depressed.

The actuator means moves the sealing means from a closed position to either a full flush position or to a half flush position. In a preferred embodiment the sealing means is a flapper-type valve and the actuator means acts on the sealing means to cause the sealing means to pivot between said closed, half flush and full flush positions.

The sealing means seals the liquid outlet when the actuator means is in. the closed position. When the sealing means is moved to either of the flush positions, the liquid outlet is opened and liquid in the reservoir is able to flow by gravity out of the liquid outlet.

When in the half flush position, the sealing means is biased toward the closed position. Preferably this bias is caused by the resolved static and dynamic fluid and gravitational forces acting on the sealing means when the sealing means is in the half flush position. When the sealing means has been moved from the closed position, liquid will flow out of the reservoir causing a venturi effect. This will result in a lower pressure acting on the lower surface of the sealing means and a greater pressure acting on the upper surface of the sealing means, the resultant net forces acting to urge the sealing means toward the closed position. Preferably when the sealing means is a flapper-valve, less pivotal movement of the sealing means away from the liquid outlet is required to put the sealing means in the half flush position than in the full flush position. In other words, when the actuator means is moved to the half flush position, the sealing means moves a first distance away from the liquid outlet, but when the actuator means is moved to the full flush position, the sealing means moves a further distance away from the liquid outlet.

Preferably when the sealing means is in the full flush position, the resolved forces acting upon it urge It to remain in that position, at least until the liquid level in the reservoir drops to a point where the sealing means is no longer covered with liquid. The sealing means may include a float which provides a buoyant force greater than any downward acting forces on the sealing means such that it remains in the full flush open position while there is still water in the reservoir but when the water level drops to below the float, the lack of buoyancy will cause the sealing means to close.

The apparatus further includes stop means co-operable with the sealing means. The stop means is biased towards a position capable of holding said sealing means in a half flush position when the actuator is moved to the half flush position. The stop means then holds the sealing means in the half flush position until a predetermined volume of liquid has been discharged from the reservoir. Thereafter, the sealing means moves to the closed position so that no more liquid is able to flow out of the liquid outlet. In a preferred embodiment, the stop means includes a cam which is capable of moving into a locking position when the sealing means is moved into the half flush position and there it is engaged by cooperating latching means associated with the sealing means. The stop means may move into the locking position by way of a float which biases the stop means toward the locking position when the float is providing upward buoyant forces, i.e. when there is liquid at least partially around the float. When the liquid level has dropped so that the float no longer provides upward buoyant forces the stop means may move away from the locking position so that the resultant forces acting on the sealing means cause the latter to move to the closed position and thus prevent further outflow of water from the reservoir.

In another aspect of the present invention there is provided a dual volume discharge apparatus for discharging liquid from a reservoir, said apparatus including:

a main liquid outlet communicating between said reservoir and a discharge passage, valve means selectively moveable between a closed position where liquid is prevented from flowing out of said reservoir into said discharge passage through said main liquid outlet and an open position where liquid is able to flow out of said reservoir into a discharge passage through said main liquid outlet, a first overflow passage having an outlet into said discharge passage and an inlet positioned at a selected fill level in said reservoir, and at least one additional overflow passage having an outlet into said discharge passage and an inlet positioned at a selected fill level in said reservoir, such that when said valve means is in said closed position and liquid in said reservoir reaches said selected fill level liquid will flow into said overflow passages and flow into said discharge passage.

Preferably the additional overflow passage or passages are connected to the apparatus in parallel with the first overflow passage. The additional overflow passages may connect to the apparatus in a modular fashion by for example, a friction fit into an openable port in the apparatus. The additional discharge passages may have a telescopic extension sleeve allowing adjustment of the height of the inlet.

The present invention will now be described in more detail with reference to a preferred embodiment illustrated in the accompanying drawings. The description will refer to a preferred form of the invention when utilised in a toilet cistern. It is to be understood that the drawings and the following description relate to a preferred embodiment only, and are not to limit the generality of the present invention.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
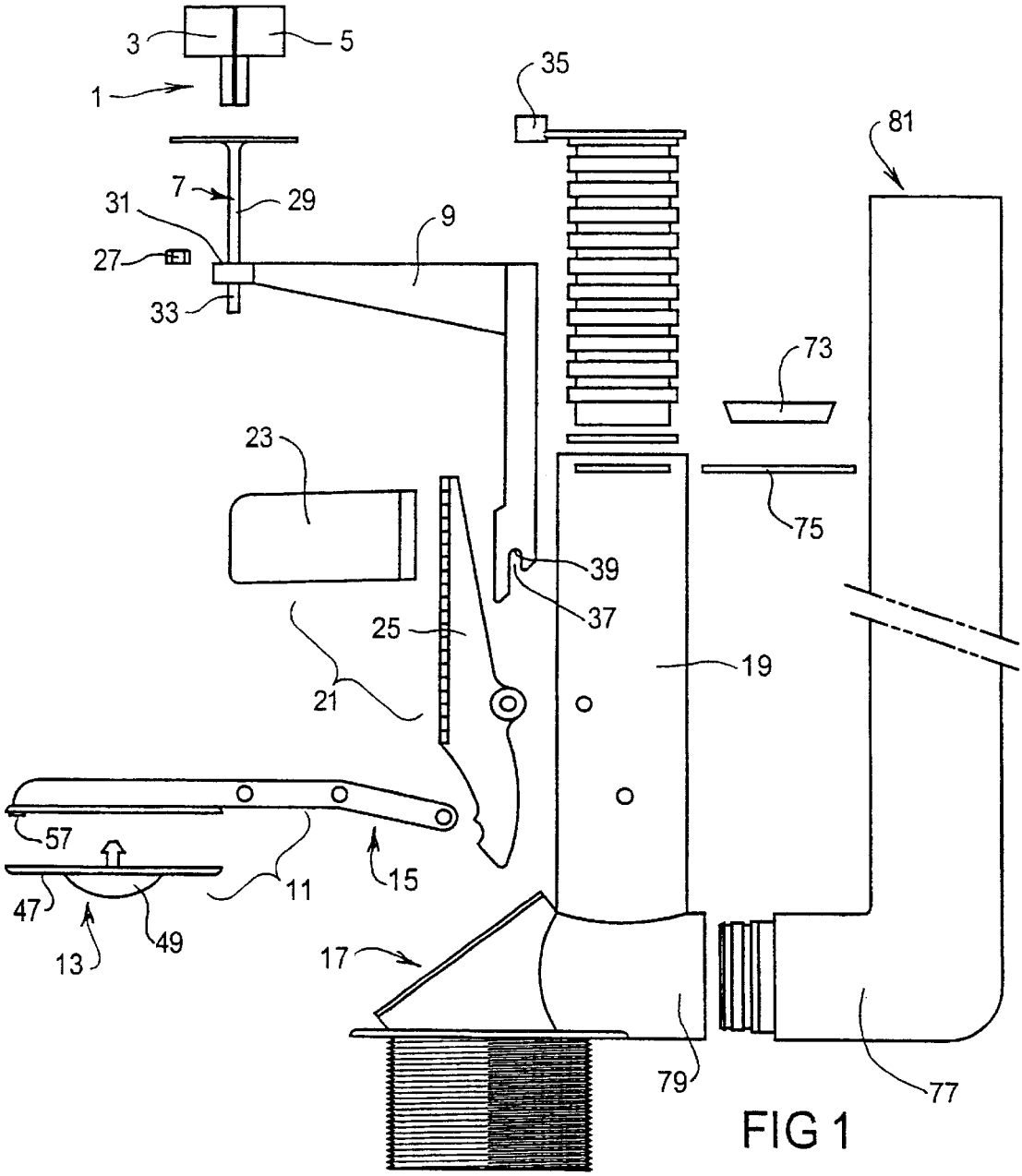
FIG. 1 is an exploded view of separate parts of an apparatus made in accordance with the present invention.

In FIG. 1, activator means 1 collectively comprises half flush button 3, full flush button 5, push rod 7 and connecting arm 9. Sealing means 11 collectively comprises float seal 13 and cantilever arm 15. Liquid outlet 17 is located in apparatus body 19. Stop means 21 collectively comprises float 23 and float guide 25.

Half and full flush buttons 3 and 5 are biased toward an upper position where they do not apply any force to the head of push rod unless they are being depressed by the user. Half and full flush buttons 3 and 5 are preferably mounted on the cover (not shown) of the cistern, and are exposed and visible to the user. The remaining parts of the apparatus are most suitably housed within the cistern and may be submerged under water when the cistern is full as is conventional in the art.

Push rod 7 has adjustment stop 27 on its shank 29 which rests on an shoulder 31 in connecting arm 9. Preferably the adjustment stop 27 can be screwed to a selected position along a thread 33 on shank 29 so that the push rod 7 can be adjusted to an optimal position relative to connecting arm 9 and half and full flush buttons 3 and 5. Alternative arrangements to a screw thread may be provided for the adjustment stop 27, although it is considered that a screw thread will provide the greatest degree of adjustability. Push rod 7 may pass through a guide 35 so as to keep its motion (when activated by either of the flush buttons) substantially linear.

Figure 2:
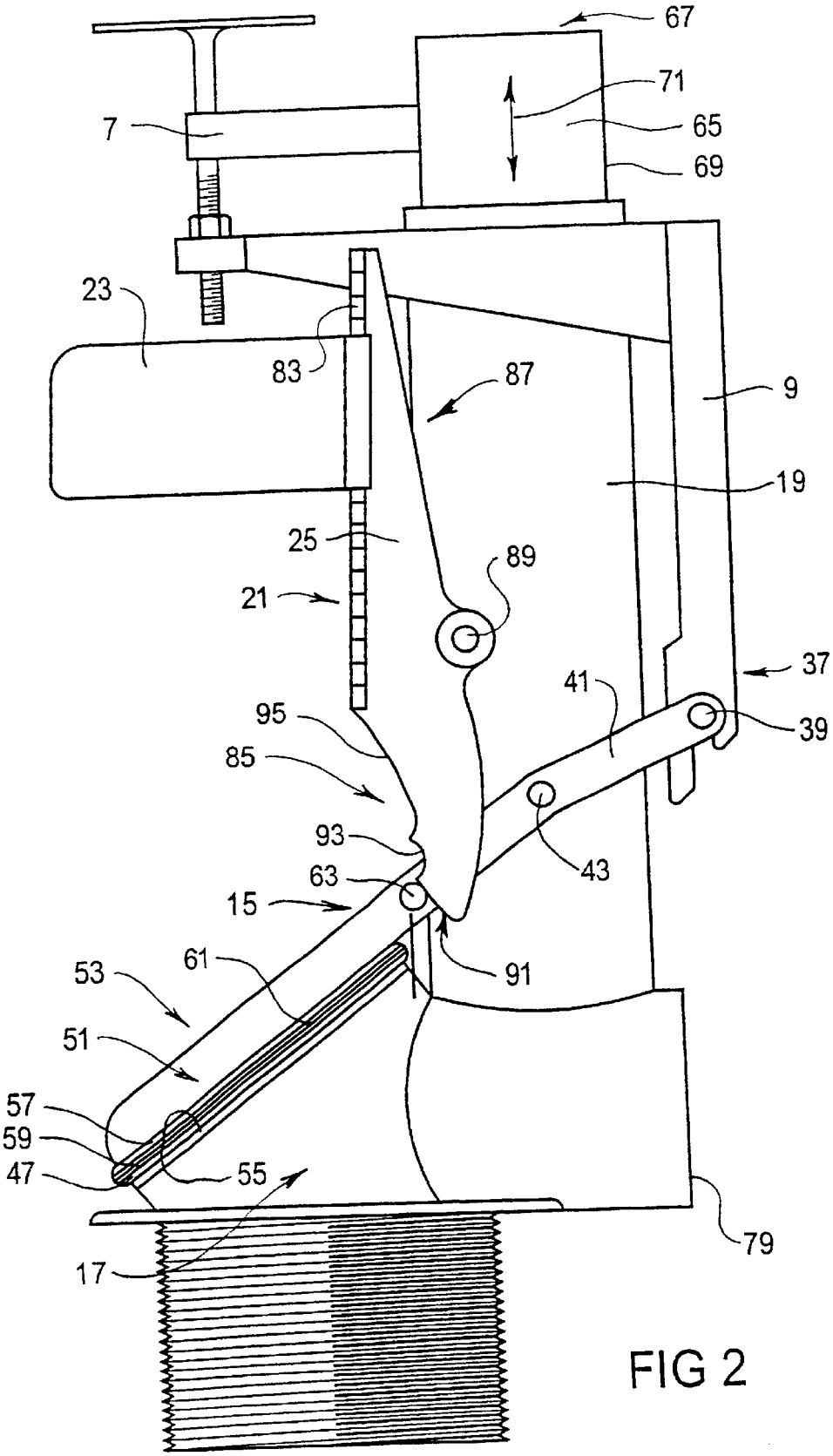
FIG. 2 is a side elevation of an apparatus of the present invention shown in the closed position.

In FIG. 2 the apparatus is shown in the closed position. This position correlates to the situation where the cistern is filled with water to the desired level and is ready to be activated to provide either a half flush or a full flush. Connecting arm 9 transfers linear downward motion of the push rod 7 to hinge point 37 where surface 39 of connection arm 9 contacts actuating end 41 of cantilever arm 15. Preferably connecting arm 9 passes around body 19 which acts as a guide to keep the motion of connecting arm 9 linear. Desirably cantilever arm 15 is hinged about pivot 43 on body 19. Seal end 45 of cantilever arm 15 has pivotally mounted thereon float seal 13 which consists of sealing gasket 47 and float 49 shown in FIG. 1. Preferably seal end 45 of cantilever arm 15 includes recesses 51 on the upper side 53 of seal end 45, said recesses 51 being capable of retaining water therein when the cistern is empty so as to provide ballast to the seal end 45 of cantilever arm 15 after the cistern has been emptied by a full flush. This ballast is the amount of water which can be retained in the recesses 51 will preferably be sufficient so as to weight down the seal end 45 to cause the sealing gasket 47 fall and come into contact with annular outlet rim 55. Seal end 45 may include a lip 57 adapted to bear upon part 59 of the upper surface 61 of sealing gasket 47 to assist in sealing liquid outlet 17. Cantilever arm 15 includes cam follower 63 between pivot 43 and seal end 45.

Body 19 is hollow and incorporates internal overflow passage 65 which extends from overflow inlet 67 to outlet 17. It will be appreciated that outlet 17 communicates with toilet pan (not shown) such that water flushed from cistern flows into the toilet pan, and water flowing down the overflow passage 65 will also flow into the pan. Overflow passage 65 includes telescopic extension sleeve 69 co-axial with the overflow passage 65 and capable of being adjusted up or down along the axis 71 of overflow passage 65. Accordingly the height of inlet 67 may be varied as desired so that the level reached by water in the cistern may be selected and determined by the degree to which the telescopic extension sleeve 69 has been extended. Telescopic extension sleeve 69 may include O-ring seal 73 to ensure water does not flow from the cistern into the overflow passage 65 through any gap between the overflow passage 65 and the extension sleeve 69. The extension sleeve 69 also preferably includes a locking clip 75 to ensure that once it has been extended to a desired height, it is locked into position. Guide 35 may be connected to and extend from telescopic extension sleeve 69.

The apparatus may further include one or more additional overflow passages 77 in parallel with the overflow passage 65 previously described. The additional overflow passage 77 or passages may be connected in a modular fashion to chamber 79. Similar to the primary overflow passage 65, the additional passage(s) may have a telescopic extension sleeve (not shown) allowing adjustment of the height of the respective overflow inlet 81, or alternatively the additional overflow passages 77 may be of fixed length. The additional overflow passages 77 may be provided to give further protection against overflow of the cistern if the cistern filling valve should fail and water continues to enter the cistern despite reaching the selected filling level.

When in the closed position and when the cistern is full, the weight of water acting on the upper surface 61 of the sealing gasket 47 will hold the gasket 47 against the annular outlet rim 55 of the outlet 17 and this will cause the hinge point 37 of actuating end 41 of cantilever arm 15 to act upon surface 39 of connecting arm 9 to keep connecting arm 9 and hence push rod 7 in an upper position.

Apparatus also includes stop means 21 which facilitates and is essential to the half flushing function of the apparatus. Stop 21 comprises a body 25 19 having a cam end 85, a float end 87 and a hinge point 89 intermediate said ends 85 and 87. The hinge point 89 is preferably hinged to the body 19 and the stop 21 is capable of pivoting between a locking position and a release position. On float end 87 there is a float 23 which is adjustably mounted to track 83. Float 23 may be adjusted along track 83 to a desired height. When cistern is full of water, float 23 will preferably be submerged below the surface of the water so that it provides a buoyant force acting upwardly on hinged stop 21.

Cam end 85 of hinged stop 21 includes three cam surfaces; a closed cam surface 91, a half flush cam surface 93 and a full flush cam surface 95. When the apparatus is in the closed position cam follower 63 bears against the closed cam surface 91. In this position the downward force of water acting on the upper surface 61 of the sealing gasket 47 is sufficient to overcome any buoyant forces acting on the float 23 so that the hinged stop 21 is held in a downwardly pivoted position. The half flush and full flush cam surfaces 93 and 95 will be described in more detail in relation to later figures.

Figure 3:
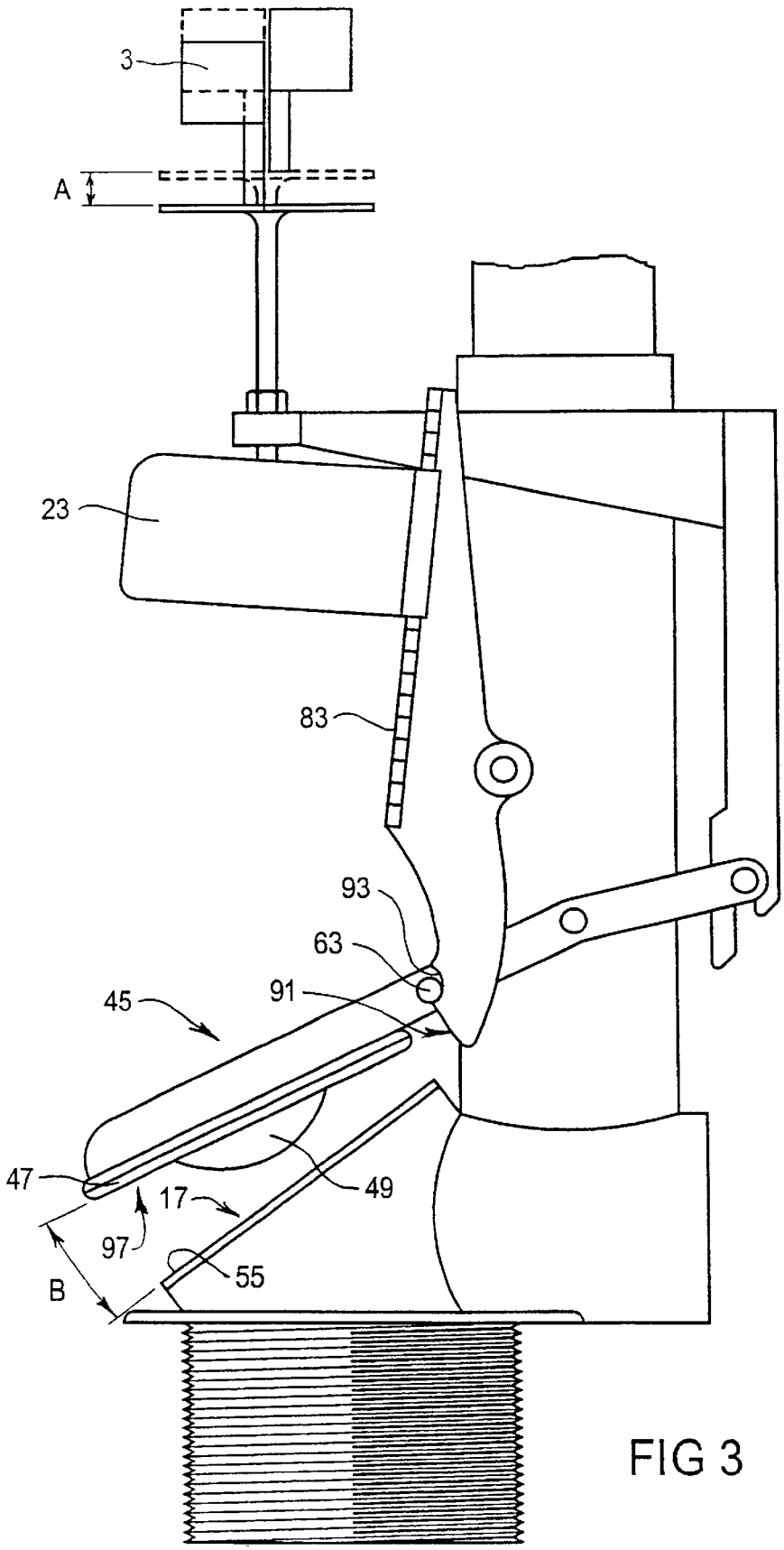
FIG. 3 is a side elevation of an apparatus of the present invention shown in the half flush position.

Turning to FIG. 3, this figure illustrates the configuration of the apparatus when a half flush has been initiated by the user and the water level in the cistern is reducing from a full level to above the selected half flush level. The half flush position is initiated by the user depressing the half flush button 3. When the half flush button 3 is depressed fully it presses upon the push rod 7 which travels distance A and causes cantilever arm 15 to raise float seal 13 distance B. In the process of moving cantilever arm 15 into the half flush position, cam follower 63 ceases to beer upon the closed cam surface 91 and hinged stop 21 is able to pivot by virtue of the buoyant forces acting on float 23 until half flush cam surface 93 comes into contact with cam follower 63. The transition from the closed position to the half flush position will generally take only a fraction of a second, being the time it takes for a user to fully depress the half flush button 3. The half flush button will then react to its normal position.

Once in the half flush position, water will evacuate from the cistern through the outlet 17 as the seal between the sealing gasket 47 and the annular outlet rim 55 will have been broken. Accordingly, the level of water in the cistern will begin to drop. The outflow of water around the seal end 45 and sealing gasket 47 and out of the outlet 17 will result in a net downward force acting on the upper surface 61 of the sealing gasket 47 such that it is urged towards the closed position. The downward forces may be made up of the mass of water above the seal end 45 and sealing gasket 47 acting downwardly on the upper surfaces 53 and 61 of those components. Additionally it is considered that there will also be a significant venturi effect caused by flow of water out of the outlet 17 resulting in a reduced pressure on the underside 97 of the sealing gasket 47. This added to the other downward forces will urge the sealing gasket 47 towards the closed position. In the half flush position however, the half flush cam surface 93 comes into contact with the cam follower 63. The shape of the half flush cam surface 93 is such that when the hinged stop 21 is biased upwardly by float 23 said surface engages with the cam follower 63 so as to prevent movement of the cantilever arm 15 towards the closed position. In other words the half flush cam surface 93 provides a temporary lock against which the cam follower 63 acts and is prevented from moving past. The locking action is sufficient to resist the downward acting forces on the seal end 45 and float seal 13 as long as there is an upward force acting on the hinged stop by virtue of the float 23 being immersed in water. Accordingly the locking action of the hinged stop 21 will remain to hold the cantilever arm 15 and float seal 13 in the half flush position until such time as the water level drops in the cistern to a point where the float 23 is no longer immersed in water. As described above, position of the float 23 can be selected by moving it up or down along track 83. Therefore by selecting an appropriate position for the float 23 on the track 83, this dictates the level at which the hinged stop 21 ceases to provide the half flush locking function and thus the sealing gasket 47 will close to prevent further flow of water out of the cistern.

When the water level has dropped to a point where the float 23 no longer provides an upward force on the hinged stop 21, the hinged stop 21 will pivot back to the downwardly pivoted position, the same as when the apparatus is in the closed position. The half flush cam surface 93 will therefore move back away from the cam follower 63 allowing the cantilever arm 15 to move to the closed position.

Figure 4:
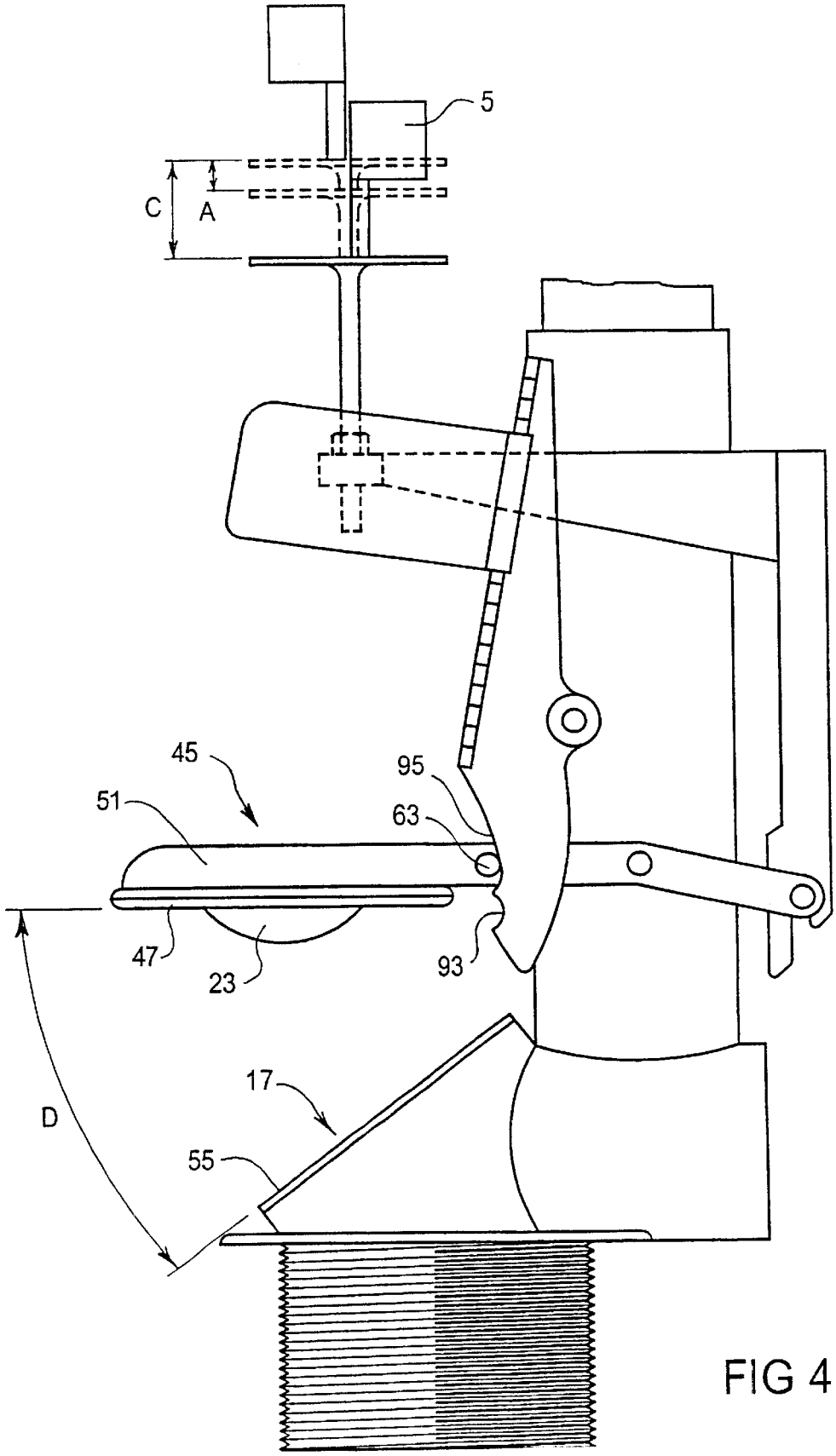
FIG. 4 is a side elevation of an apparatus of the present invention shown in the full flush position.

FIG. 4 shows the apparatus in the full flush position. This position is adopted when the user depresses the full flush button 5. The full flush button 5 moves push rod 7 distance C, which is greater than distance A. This causes cantilever arm 15 to raise float seal 13 distance D. It can be seen that in the process of moving cantilever arm 15 into the full flush position, cam follower 63 moves past the half flush position until it bears on full flush cam surface 95. Again the transition from the closed position to the full flush position will generally only take a fraction of a second, being the time it takes for a user to fully depress the full flush button 5. Full flush button then retracts to its normal position. The speed of actuation is such that half flush cam surface 93 of the hinged stop 21 does not have time to engage the cam follower 63 as the cantilever arm 15 is moved from the closed position through the half flush position to the full flush position. The cam follower 63 may abut the full flush cam surface 95 although the action between this surface and the cam 63 is not critical.

When in the full flush position, water will evacuate from the cistern through the outlet 17 as the seal between the sealing gasket 47 and the annular outlet rim 55 will have been broken. The level of water in the cistern will drop. In the full flush position, although water will be flowing around the sealing gasket 47 and the seal end 45, sealing gasket 47 will be positioned such a distance away from the any venturi effect described above such that there is little if any such downward force acting upon it. Further, float 23 will have an upwardly acting buoyancy force acting upon its surface because float 23 will be surrounded with water, unlike the situation in the half flush position. The net forces acting on the cantilever arm 15 in the full flush position while the water level is above the seal end 45 and float 23 will cause it to remain in that position.

As the water level drops to a point where the float 23 no longer provides a dominant upward force, which will generally be when the water level has dropped to the position of the float 23, the downward forces acting on the seal end 45 will cause the cantilever arm 15 to move to the closed position. At such a point, a full flush volume of water will have been discharged from the cistern. Water trapped in the recesses 51 of the seal end 45 will provide a mass to assist in moving the apparatus to the closed position. As the water level rises to fill the cistern in preparation for a future flush the mounting downward forces acting on the sealing gasket 47 will hold it in the closed position.

The apparatus may be made from any suitable materials by any suitable means. For example, various components of the apparatus may be made by injection moulding of polymeric materials.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A dual volume discharge apparatus for selectively discharging a full flush or a half flush of liquid from a reservoir, said discharge apparatus including:

sealing means pivotable between a closed position, a half flush position and full flush position and having a cam engaging portion engageable with a cam when said sealing means is in said half flush position, said sealing means being biased to said closed position when in said half flush position;

actuating means capable of selectively moving said sealing means to either of said half flush or full flush positions;

a fluid outlet which is sealed when said sealing means is in said closed position and which allows discharge of said flush from said reservoir when said sealing means is in said half flush or full flush positions; and stop means having a cam and a float mounted to a track thereon, said stop means being pivotable between a first position where said cam co-operates with said cam engaging portion when said float is substantially immersed in said liquid and a second position where said cam disengages with said cam engaging portion when said float is not substantially immersed in said liquid;

wherein when the actuating means selectively moves said sealing means to said half flush position, said cam and cam engaging portion co-operate to keep said sealing means in said half flush position until said float is no longer substantially immersed in said liquid, whereupon said sealing means reverts to said closed position.

2. The apparatus according to claim 1, wherein said actuator means includes means for selecting either the full flush or the half flush.

3. The apparatus according to claim 2, wherein said actuator means includes a first selection means adapted to move said actuator means from the closed position to said half flush position, and a second selection means adapted to move said actuator means from said closed position to said full flush position.

4. The apparatus according to claim 3, wherein said first and second selection means each comprise a pressable button.

5. The apparatus according to claim 3, wherein said half flush position is intermediate the closed and full flush positions and the distance the first selection means moves said actuator means when depressed is less than the distance the second selection means moves the actuator means when depressed.

6. The apparatus according to claim 1, wherein said sealing means is a flapper valve and said actuator means acts on said valve to cause the valve to pivot between said closed, half flush and full flush positions.

7. The apparatus according to claim 1, wherein when said sealing means is in said full flush position, the sealing means remains in said full flush position until the liquid level in the reservoir drops to where said sealing means is no longer covered with liquid.

8. The apparatus according to claim 1, wherein said sealing means includes a float such that when said sealing means is moved to said full flush position, said float holds said sealing means in said full flush position while there is liquid surrounding said float.

9. The apparatus according to claim 1, wherein said stop means includes a cam capable of moving into a locking position when said sealing means is moved into said half flush position and is engaged by co-operating latching means on said sealing means.

10. The apparatus according to claim 9, wherein said stop means includes a float which biases said stop means towards said locking position when liquid at least partially surrounds said float, and wherein said stop means moves to a closed position when the liquid level has dropped to a predetermined level.

11. The apparatus according to claim 1, and further including a main liquid outlet communicating between said reservoir and a discharge passage, a first overflow passage having an outlet into said discharge passage, and an inlet positioned at a selected fill level in said reservoir, and at least one additional overflow passage having an outlet into said discharge passage and an inlet positioned at a selected fill level in said reservoir, such that when said sealing means is in said closed position and liquid in said reservoir reaches said selected fill level, liquid flows into said overflow passages and into said discharge passage.

12. The apparatus according to claim 11, wherein said additional overflow passage or passages are connected to said apparatus in parallel to said first overflow passage.

13. The apparatus according to claim 1, and further including an overflow passage which is telescopically extendable.

14. A dual volume discharge apparatus for selectively discharging a full flush or a half flush of liquid from a reservoir, said discharge apparatus including:

a seal pivotable between a closed position, a half flush position and full flush position and having a cam engaging portion engageable with a cam when said seal is in said half flush position, said seal being biased to said closed position when in said half flush position;

an actuator capable of selectively moving said seal to either of said half flush or full flush positions;

a fluid outlet which is sealed when said seal is in said closed position and which allows discharge of said flush from said reservoir when said seal is in said half flush or full flush positions; and a stop having a cam and a float mounted to a track thereon, said stop being pivotable between a first position where said cam co-operates with said cam engaging portion when said float is substantially immersed in said liquid and a second position where said cam disengages with said cam engaging portion when said float is not substantially immersed in said liquid;

wherein when the actuator selectively moves said seal to said half flush position, said cam and cam engaging portion co-operate to keep said seal in said half flush position until said float is no longer substantially immersed in said liquid, whereupon said seal reverts to said closed position.

15. The apparatus according to claim 14, and further including an overflow passage which is telescopically extendable.

16. The apparatus according to claim 14, wherein said seal includes a float such that when said seal is moved to said full flush position; said float holds said seal in said full flush position while there is liquid surrounding said float.

17. The apparatus according to claim 14, wherein said actuator is selectively movable between the full flush or the half flush.

18. The apparatus according to claim 17, wherein said actuator includes a first selector adapted to move said actuator from the closed position to said half flush position, and a second selector adapted to move said actuator from said closed position to said full flush position.

19. The apparatus according to claim 18, wherein said first and second selectors each comprise a pressable button.

20. The apparatus according to claim 18, wherein said half flush position is intermediate the closed and full flush positions and the distance the first selector moves said actuator when depressed is less than the distance the second selector moves the actuator when depressed.

21. The apparatus according to claim 14, wherein said seal is a flapper valve and said actuator acts on said valve to cause the valve to pivot between said closed, half flush and full flush positions.

22. The apparatus according to claim 14, wherein when said seal is in said full flush position, the seal remains in said full flush position until the liquid level in the reservoir drops to where said seal is no longer covered with liquid.

23. The apparatus according to claim 14, wherein said stop includes a cam capable of moving into a locking position when said seal is moved into said half flush position and is engaged by co-operating latching means on said seal.

24. The apparatus according to claim 23, wherein said stop includes a float which biases said stop towards said locking position when liquid at least partially surrounds said float, and wherein said stop moves to a closed position when the liquid level has dropped to a predetermined level.

25. The apparatus according to claim 14, and further including a main liquid outlet communicating between said reservoir and a discharge passage, a first overflow passage having an outlet into said discharge passage, and an inlet positioned at a selected fill level in said reservoir, and at least one additional overflow passage having an outlet into said discharge passage and an inlet positioned at a selected fill level in said reservoir, such that when said seal is in said closed position and liquid in said reservoir reaches said selected fill level, liquid flows into said overflow passages and into said discharge passage.

26. The apparatus according to claim 25, wherein said additional overflow passage or passages are connected to said apparatus in parallel to said first overflow passage.

* * * * *